US012538995B2

(12) United States Patent
Wagner

(10) Patent No.: US 12,538,995 B2
(45) Date of Patent: Feb. 3, 2026

(54) SHOWER CURTAIN CLOSURE DEVICE

(71) Applicant: Ryan Wagner, Braham, MN (US)

(72) Inventor: Ryan Wagner, Braham, MN (US)

( * ) Notice: Subject to any disclaimer, the term of this patent is extended or adjusted under 35 U.S.C. 154(b) by 234 days.

(21) Appl. No.: 18/238,266

(22) Filed: Aug. 25, 2023

(65) Prior Publication Data

US 2025/0064249 A1 Feb. 27, 2025

(51) Int. Cl.
*A47H 5/02* (2006.01)
*A47K 3/38* (2006.01)

(52) U.S. Cl.
CPC ..... *A47H 5/02* (2013.01); *A47K 3/38* (2013.01)

(58) Field of Classification Search
CPC ..... A47H 5/02; A47H 5/0325; A47H 5/032; A47H 5/06; A47K 3/38
See application file for complete search history.

(56) References Cited

U.S. PATENT DOCUMENTS 425,688 A * 4/1890 Morgan ..... A47H 5/06 160/343
1,346,747 A * 7/1920 Hamilton ..... A47H 5/032 160/370
1,653,586 A * 12/1927 Remhof ..... A47H 5/02 160/344
3,631,543 A 1/1972 Laauser
4,610,294 A * 9/1986 Anesi ..... A47H 5/0325 160/331
4,955,422 A * 9/1990 Irizarry ..... A47K 3/38 160/344
4,958,112 A * 9/1990 Zerillo ..... A47H 5/0325 318/16
5,371,447 A * 12/1994 Boss ..... A47H 5/0325 318/470
6,297,604 B1 * 10/2001 Mao ..... A47H 5/0325 160/331
8,381,327 B2 2/2013 Betzen
9,044,115 B1 * 6/2015 Chirigotis ..... A47K 3/38
9,192,267 B2 11/2015 Tsibulevskiy
10,194,773 B2 * 2/2019 Foreman ..... A47H 1/06
10,292,538 B2 5/2019 Tsibulevskiy
10,724,298 B2 * 7/2020 Colson ..... E06B 9/42
11,418,863 B2 * 8/2022 Lynch ..... G06F 3/165
2009/0083904 A1 4/2009 Roston
2017/0079482 A1 * 3/2017 Tsibulevskiy ..... E03C 1/0408
2022/0240728 A1 * 8/2022 Alanazi ..... A47K 3/38

FOREIGN PATENT DOCUMENTS

CN 2530546 1/2003

* cited by examiner

*Primary Examiner* — Abe Massad

(57) ABSTRACT

A shower curtain closure device for automatically closing a shower curtain includes a housing having a front side, a back side, and a peripheral wall extending therebetween, defining an interior space. The front side has a shower rod recess therein that is configured to receive a portion of a shower curtain rod. A spool is positioned within the interior space. A cord having a spool end and a clip end is coupled to the housing. The spool end is attached to the spool and the cord is wrapped around the spool. The spool rotates to wrap and unwrap the cord, such that the cord retracts into and extends from the housing. A curtain clip is attached to the clip end that can removably engage a shower curtain ring. A motor is positioned within the interior space. The motor is coupled to the spool, rotating the spool to retract the cord.

18 Claims, 8 Drawing Sheets

SHOWER CURTAIN CLOSURE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to curtain drawing devices and more particularly pertains to a new curtain drawing device for automatically closing a shower curtain.

(2) Description of Related Art Including Information Disclosed Under 37 CFR 1.97 and 1.98

The prior art relates to curtain drawing devices. The prior art discloses various devices that can clamp onto a shower curtain, curving the curtain inward toward the shower to eliminate the gap between the curtain and the wall. Such devices seal the curtain to the wall, thereby directing water downwardly into the shower and reducing the amount of water that splashes out of the shower into other areas in the bathroom. Other prior art references disclose collapsible shower curtains or partitions that can be easily transported and deployed to create a movable shower area. Such collapsible curtains may be used to facilitate showering while camping or travelling. Other references disclose electric curtain-drawing devices, typically for use with window curtains or large stage curtains. Such electric curtain-drawing devices can mechanically open and close large or heavy curtains that are inconvenient to open and close manually. However, the prior art lacks disclosure of an automated or mechanical shower curtain closure device that automatically closes a shower curtain. For example, such devices are helpful when a user forgets to close the shower curtain manually.

BRIEF SUMMARY OF THE INVENTION

An embodiment of the disclosure meets the needs presented above by generally comprising a housing having a front side, a back side, and a peripheral wall extending between the front side and the back side to define an interior space between the front side and the back side. The front side has a shower rod recess therein that is configured to receive a portion of a shower curtain rod. A cord is coupled to the housing, the cord having a spool end and a clip end. A spool is positioned within the interior space. The spool end is attached to the spool and the cord is wrapped around the spool. The spool rotates in a first direction to unwrap the cord for extension of the cord from the spool. The spool rotates in a second direction to wrap the cord around the spool for retraction of the cord onto the spool. A curtain clip is attached to the clip end. The curtain clip is configured to removably engage a shower curtain ring. A central processing unit is positioned within the interior space. A motor is positioned within the interior space and is in communication with the central processing unit. The motor is coupled to the spool, such that the motor rotates the spool in the second direction to retract the cord into the housing and onto the spool. A power source is positioned within the interior space and is electronically coupled to the central processing unit. A retracting button is positioned on the housing. The retracting button is electronically coupled to the central processing unit. The retracting button actuates the motor to retract the cord.

There has thus been outlined, rather broadly, the more important features of the disclosure in order that the detailed description thereof that follows may be better understood, and in order that the present contribution to the art may be better appreciated. There are additional features of the disclosure that will be described hereinafter, and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
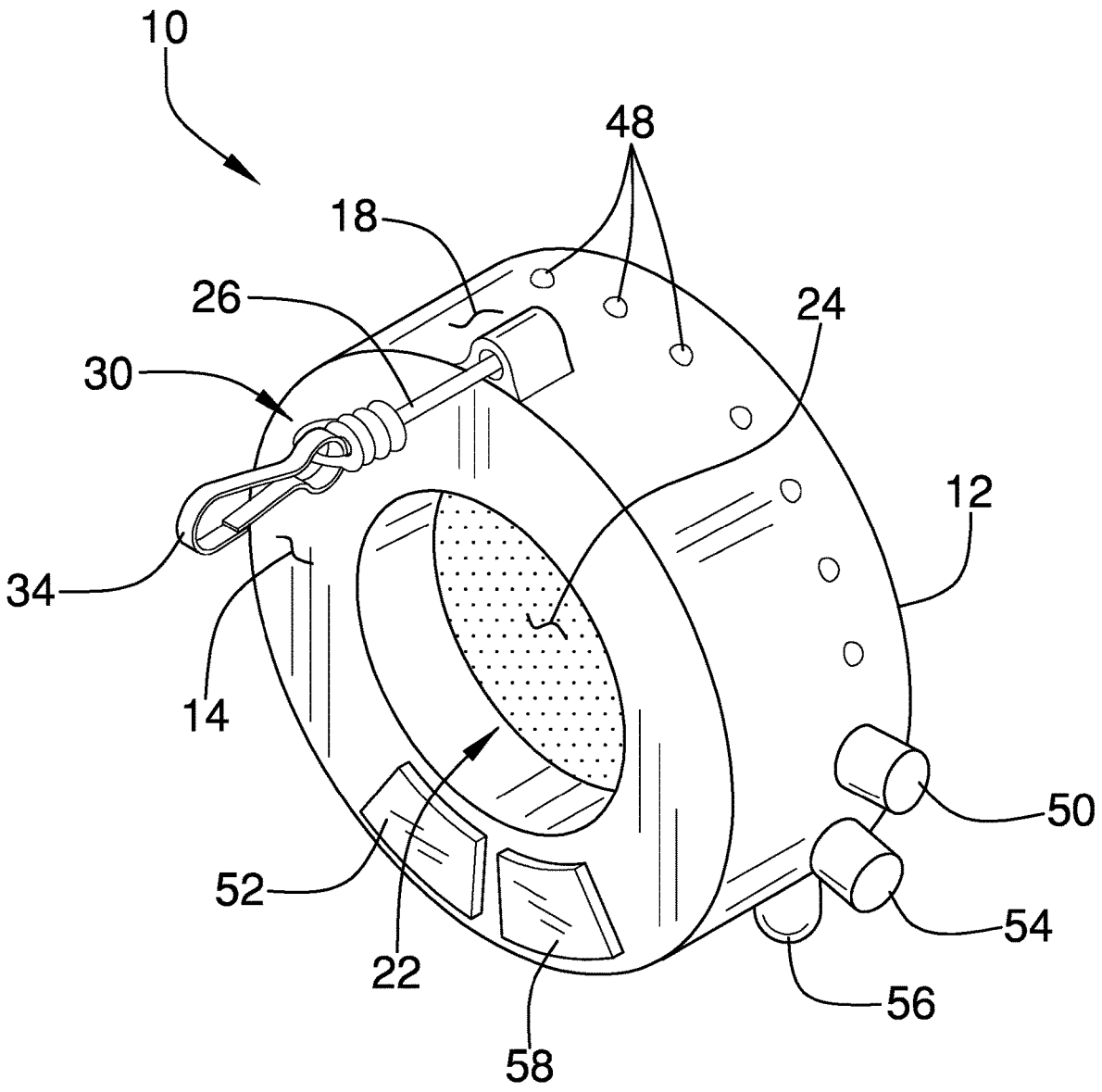
FIG. 1 is a front isometric view of a shower curtain closure device according to an embodiment of the disclosure.
Figure 2:
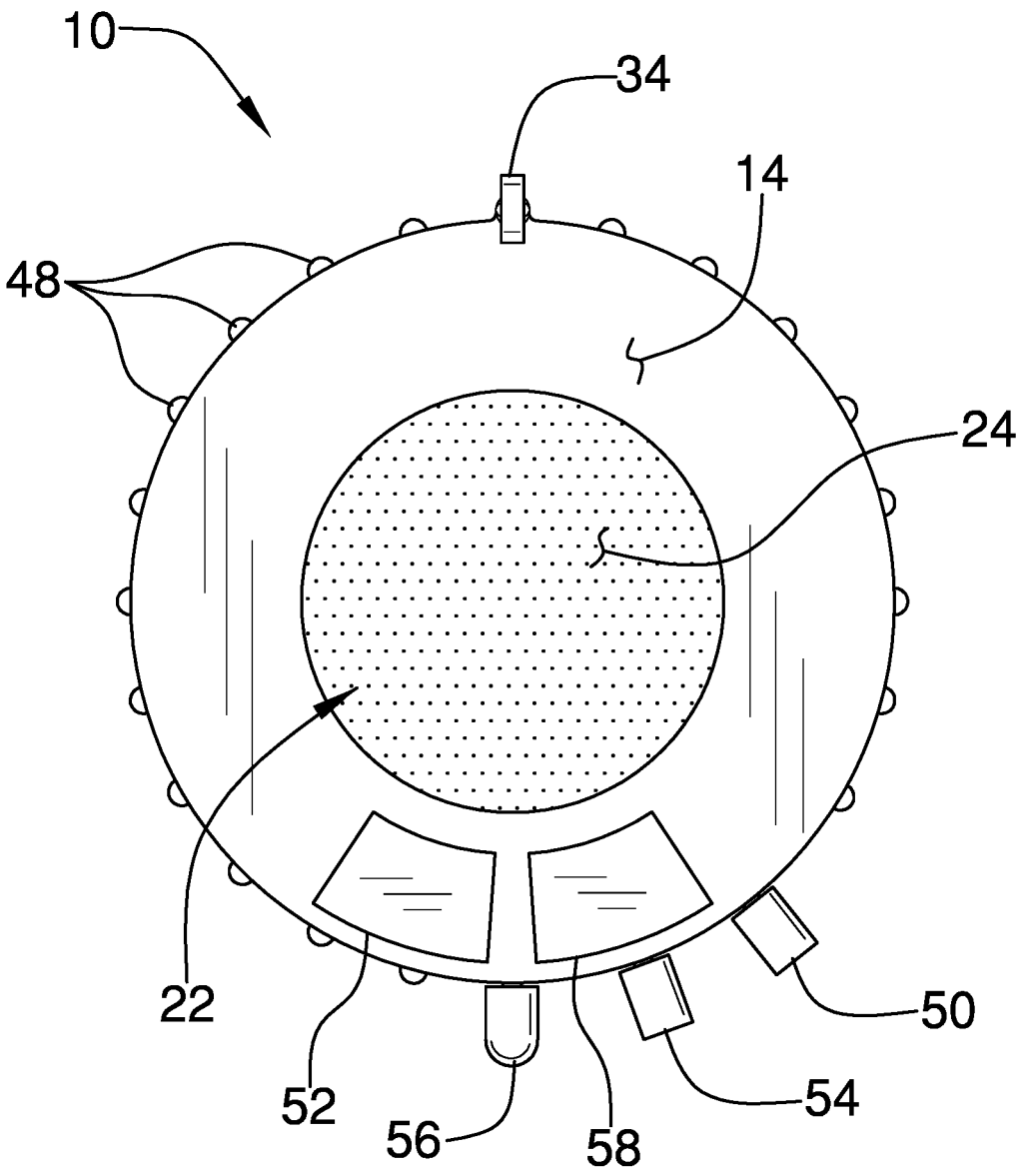
FIG. 2 is a front view of an embodiment of the disclosure.
Figure 3:
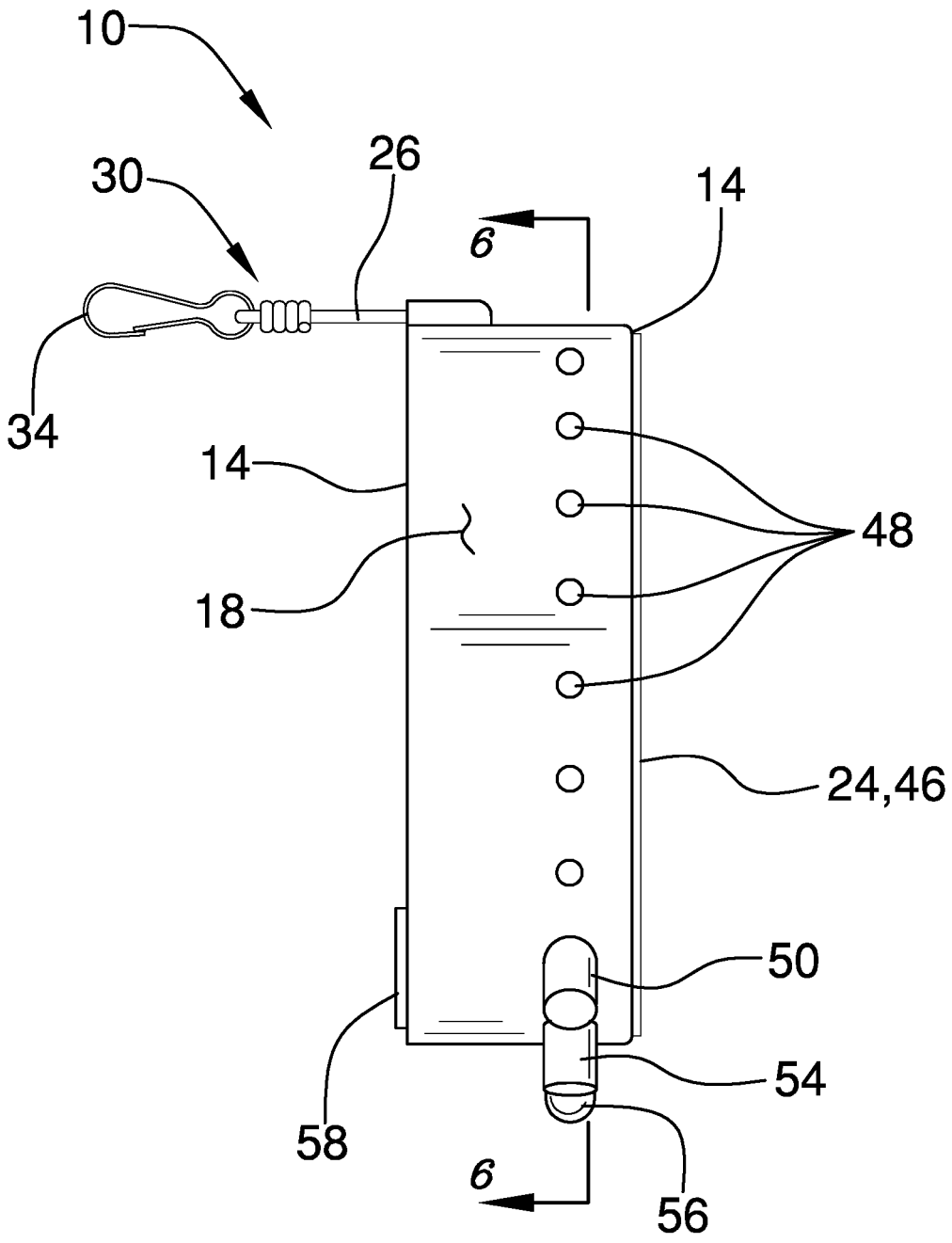
FIG. 3 is a side view of an embodiment of the disclosure.

With reference now to the drawings, and in particular to FIGS. 1 through 8 thereof, a new curtain drawing device embodying the principles and concepts of an embodiment of the disclosure and generally designated by the reference numeral 10 will be described.

As best illustrated in FIGS. 1 through 8, the shower curtain closure device 10 generally comprises a housing 12 having a front side 14, a back side 16, and a peripheral wall 18 extending between the front side 14 and the back side 16 to define an interior space 20. The housing 12 is generally configured to inhibit penetration of water into the interior space 20. For example, the housing 12 may be formed of plastic or another water-resistant material. Any gaps or openings within the housing 12 may be sealed to inhibit water flow into the interior space 20, thereby reducing the risk that components or elements of the shower curtain closure device 10 that are housed within the interior space 20 will be affected by water damage.

The front side 14 has a shower rod recess 22 therein. The shower rod recess 22 is configured to receive a portion of a shower curtain rod 100. The shower rod recess 22 may extend partially across the front side 14, as shown in FIG. 1. In some embodiments the shower rod recess 22 has a circular shape. A padding material 24 may cover the housing 12 within the shower rod recess 22. For example, the padding material 24 may comprise a textured silicone material that provides an anti-slip grip onto the shower curtain rod 100. For example, the textured silicone material may comprise a resiliently compressible padding material with raised silicone bumps or ridges that increase the friction between the shower curtain rod 100 and the housing 12 within the shower rod recess 22.

A cord 26 is coupled to the housing. In some embodiments, the cord 26 may be coupled to the front side 14, while in other embodiments the cord 26 may be coupled to the peripheral wall 18. The cord 26 extends outwardly from the front side 14. The cord 26 has a spool end 28 and a clip end 30.

A spool 32 is positioned within the interior space 20. The spool end 28 is attached to the spool 32. The cord 26 is coiled around the spool 32. The spool 32 rotates in a first direction to uncoil the cord 26 for extension of the cord 26 from the spool 32. The spool 32 rotates in a second direction to coil the cord 26 around the spool 32 for retraction of the cord 26 onto the spool 32. In some embodiments, the first direction may be counterclockwise, and the second direction may be clockwise. In other embodiments, the first direction may be clockwise, and the second direction may be counterclockwise. The spool 32 should rotate relatively freely and easily in both the first and the second direction so that the shower curtain 104 can move smoothly along the shower curtain rod 100 to open and close. The shower curtain 104 should be able to open and close manually in the same manner as if the shower curtain closure device 10 were not coupled to the shower curtain 104 or the shower curtain rod 100.

Figure 7:
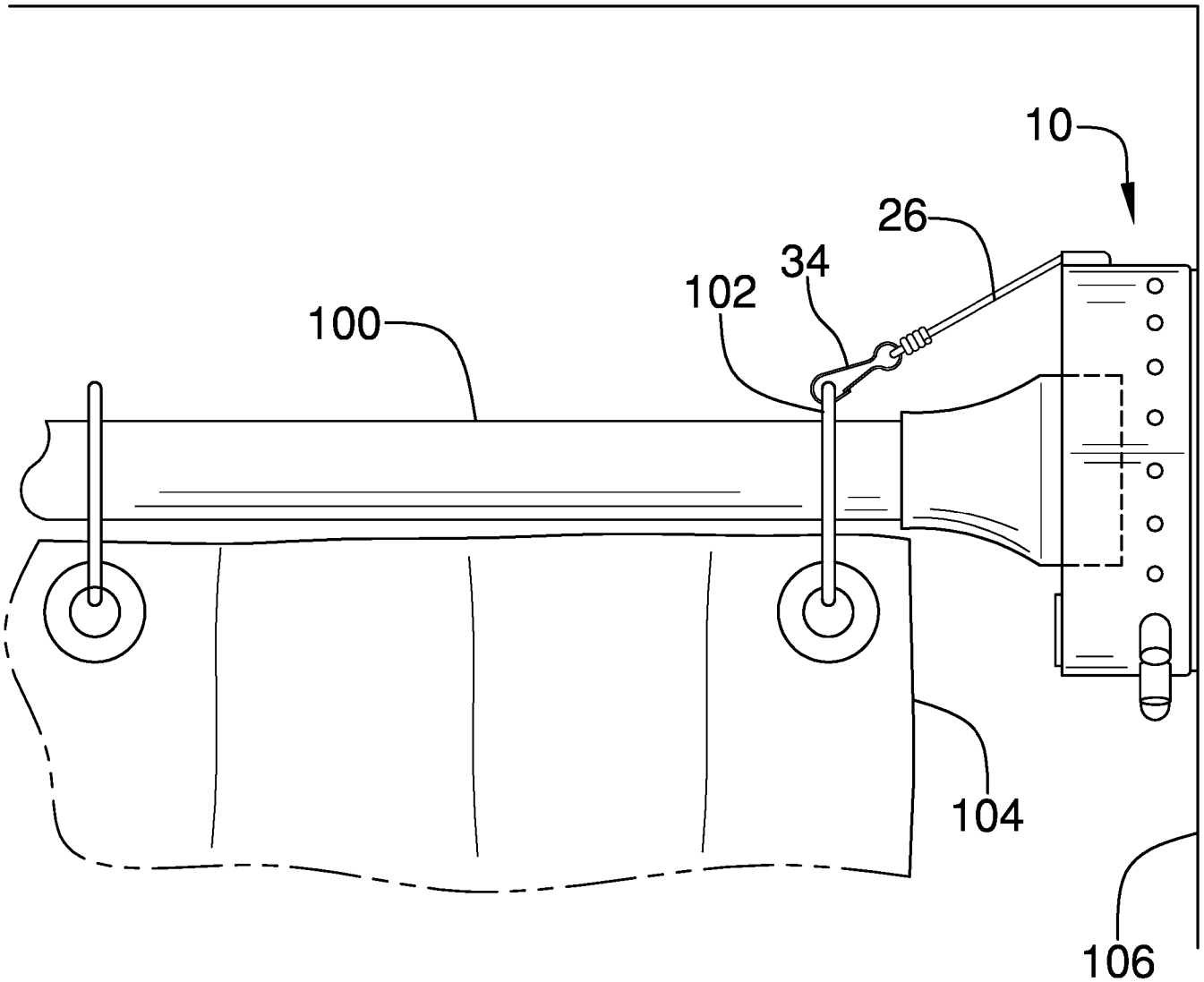
FIG. 7 is an in-use view of an embodiment of the disclosure.
Figure 8:
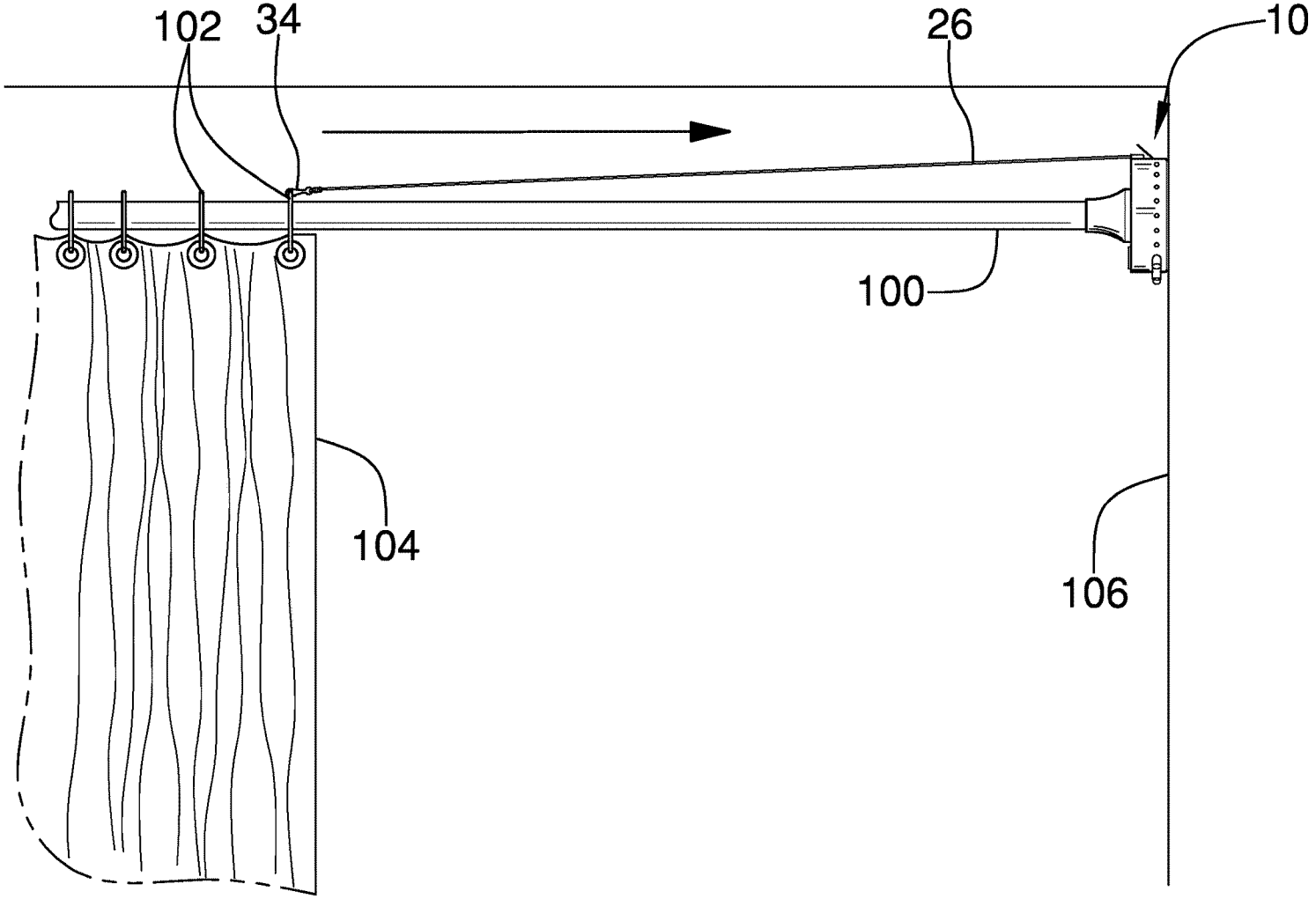
FIG. 8 is an in-use view of an embodiment of the disclosure.

A curtain clip 34 is attached to the clip end 30. The curtain clip 34 is configured to removably engage a shower curtain ring 102. As shown in FIGS. 7 and 8, the curtain clip 34 may engage the shower curtain ring 102 that is closest to the shower curtain closure device 10. For example, the shower curtain ring 102 may engage the outermost shower curtain ring 102 that is closest to the portion of the shower curtain rod 100 that is received by the shower rod recess 22. In other embodiments, the shower curtain ring 102 may engage a different shower curtain ring 102, for example based on a preference of a user for how the shower curtain 104 will be closed.

A central processing unit 36 is positioned within the interior space 20. In some embodiments, a clock 38 is electronically coupled to the central processing unit 36. The clock 38 may be able to measure or monitor the time of day, in minutes and hours. The clock 38 may also have an alarm that can be scheduled for a particular time of day and a timer that can measure the passage of minutes or hours.

A motor 40 is positioned within the interior space 20. The motor 40 is electronically coupled to the central processing unit 36. The motor 40 is coupled to the spool 32. The central processing unit 36 can actuate the motor 40 such that the motor 40 rotates the spool 32 in the second direction, thereby retracting the cord 26 into the housing 12 and onto the spool 32. The motor 40 actively turns the spool 32 in the second direction but does not prevent the spool 32 from turning in the first direction, for example when the user manually pulls the shower curtain 104 open. In embodiments, the motor 40 may have an output shaft 60 that is coupled to a gear 62. The gear 62 may be coupled to the spool 32. For example, the teeth of the gear 62 may engage the complementary teeth of the spool 32. In such embodiments, the motor 40 turns the output shaft 60 in the second direction, which rotates the gear 62, thereby rotating the spool 32 and retracting the cord 26. To extend the cord 26, the user can simply pull the shower curtain 104 open or pull on the cord 26 directly. When the cord 26 is pulled outwardly from the housing 12, the spool 32 will rotate in the first direction, which will rotate the gear 62 in the first direction. The motor 40 and output shaft 60 will not impede movement of the gear 62 or the spool 32 in the first direction.

Figure 4:
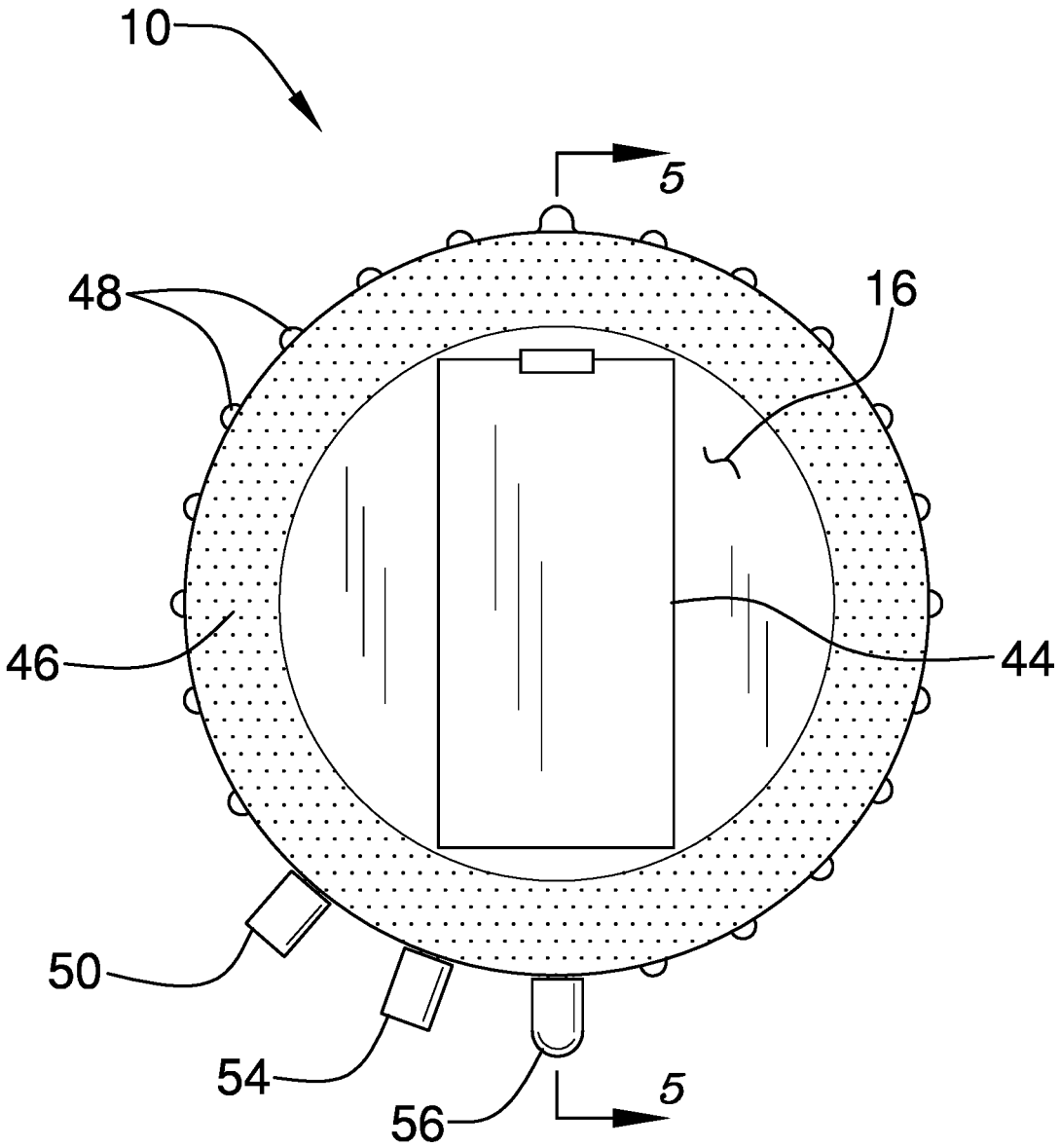
FIG. 4 is a rear view of an embodiment of the disclosure.
Figure 5:
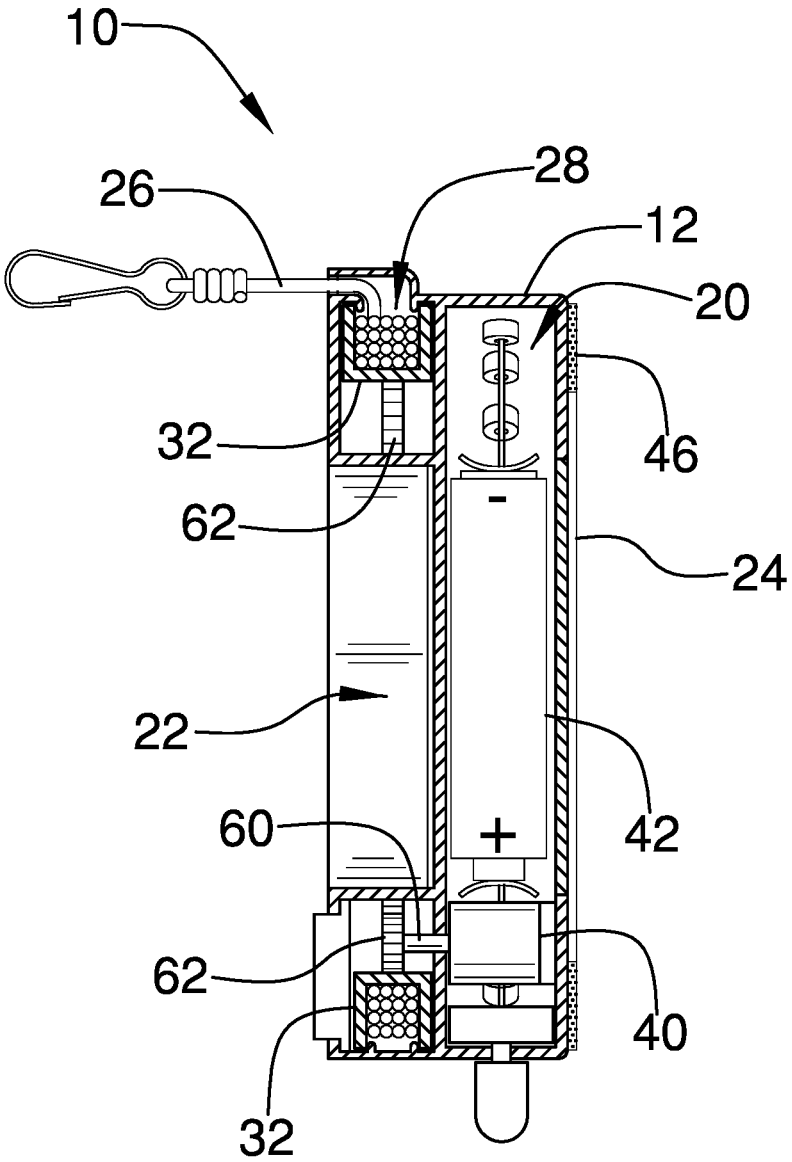
FIG. 5 is a cross-sectional view of an embodiment of the disclosure.
Figure 6:
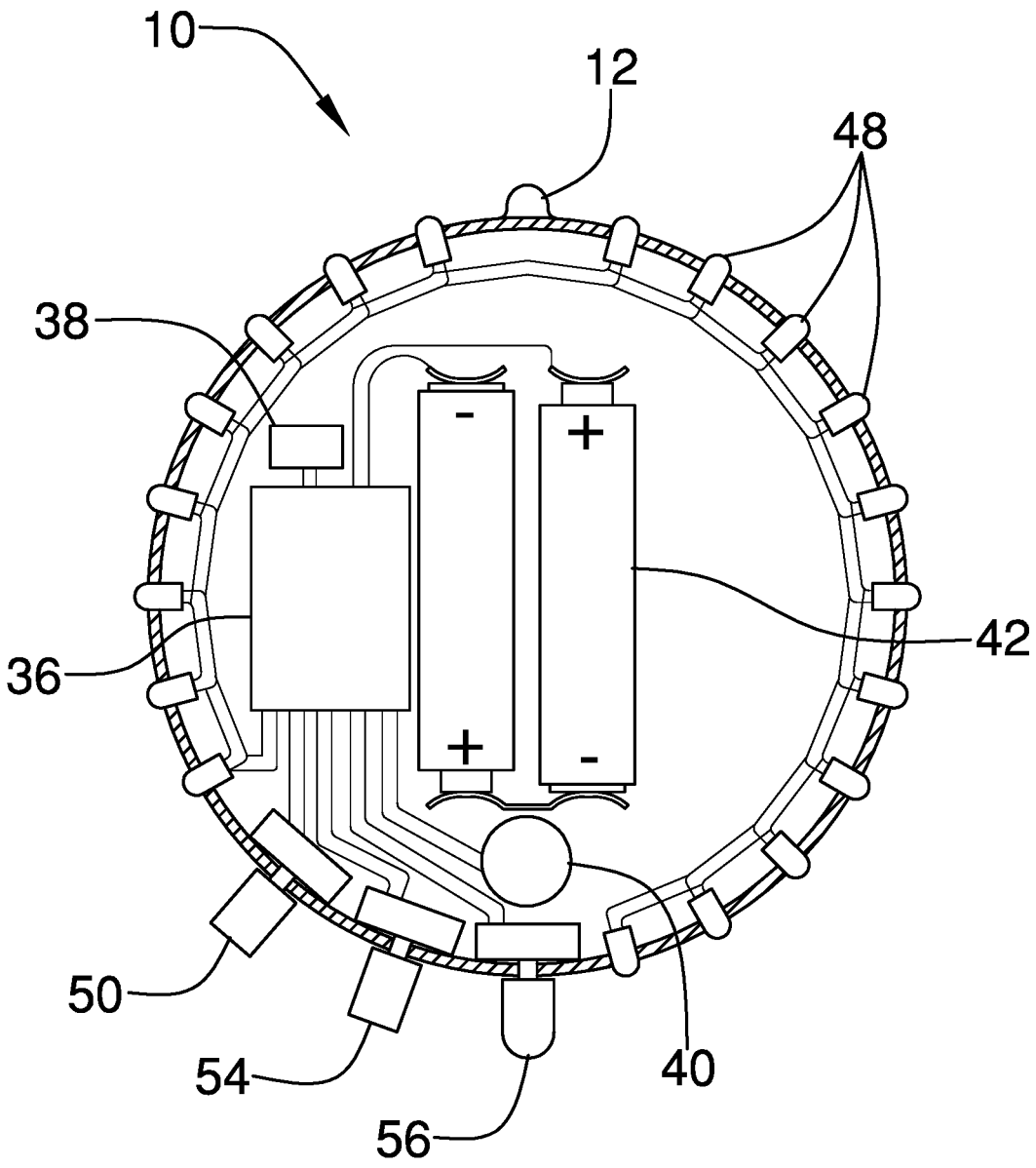
FIG. 6 is a cross-sectional view of an embodiment of the disclosure.

A power source 42 is positioned within the interior space 20. The power source 42 is electronically coupled to the central processing unit 36. In some embodiments, the power source 42 is a rechargeable battery. In other embodiments, the power source 42 is a non-rechargeable battery. An access door 44 is positioned on the back side 16. The access door 44 permits access to the power source 42 within the interior space 20. For example, the access door 44 may be positioned in a midsection of the back side 16, as shown in FIG. 4. In other embodiments, the access door 44 may be positioned elsewhere, such as on the peripheral wall 18 or along one edge of the back side 16.

An adhesive material 46 may be positioned on the back side 16. The adhesive material 46 helps secure the shower curtain closure device 10 onto a wall 106. For example, the adhesive material 46 may extend across an outer circumference of the back side 16, such that the adhesive material 46 encircles the access door 44. Alternatively, the adhesive material 46 may only cover a portion of the outer circumference of the back side 16. In other embodiments, there is no adhesive material 46. In such embodiments, the tension from the shower curtain rod 100 against the wall 106 provides enough force to keep the shower curtain closure device 10 in place against the wall 106. In other embodiments, the adhesive material 46 is the same material as the padding material 24, for example when the padding material 42 includes a textured silicone material that is configured to increase friction between the wall 106 and the padding material 42 so that the shower curtain closure device 10 is more likely to stick to the wall 106. For example, the textured silicone material may comprise a resiliently compressible padding material with raised silicone bumps or ridges that increase the friction between the shower curtain closure device 10 and the wall 106.

Some embodiments may also include the padding material 24 positioned on the back side 16. For example, the padding material 24 may be positioned within the outer circumference, encircled by the adhesive material 46. In such embodiments, the padding material 24 may cover at least a portion of the area between the outer circumference and the access door 44. The padding material 24 may be included to provide an anti-slip grip to the surface of the wall 106. The padding material 24 may also provide a protective barrier between the shower curtain closure device 10 and the wall 106, helping reduce the risk that the shower curtain closure device 10 will damage the wall 106. Other embodiments may not include the padding material 24 on the back side 16, or within the shower rod recess 22.

A plurality of lights 48 may be affixed to the peripheral wall 18. The plurality of lights 48 is electronically coupled to the central processing unit 36. For example, each of the plurality of lights 48 may be a light emitting diode.

A light control dial 50 may be rotatably positioned on the peripheral wall 18. The light control dial 50 may alternatively be rotatably positioned on the front side 14. The light control dial 50 is electronically coupled to the central processing unit 36. The light control dial 50 is actuatable to adjust a light setting of the plurality of lights 48. In exemplary embodiments, the light setting includes a brightness, a color, or an illumination pattern of the plurality of lights 48. In some embodiments, the clock 38 may communicate with the central processing unit 36 such that the plurality of lights 48 is actuated at a specific time of day or upon expiration of the timer.

A light control button 52 may be positioned on the front side 14. Alternatively, the light control button 52 may be positioned on the peripheral wall 18. The light control button 52 is electronically coupled to the central processing unit 36. The light control button 52 is actuatable to turn the plurality of lights 48 on or off.

A timer dial 54 may be rotatably positioned on the peripheral wall 18. Alternatively, the timer dial 54 may be rotatably positioned on the front side 14. The timer dial 54 is electronically coupled to the central processing unit 36. The timer dial 54 is actuatable to adjust a clock setting of the clock 38, such as the time of day, the alarm, or the timer. For example, the clock setting may include an hourly timer lasting at least 1.0 hour, a minute timer lasting at least 1.0 minute, or a second timer lasting at least 1.0 second. The central processing unit 36 is configured to actuate the motor 40 to retract the cord 26 based on the clock setting. For example, the central processing unit 36 may actuate the motor 40 upon expiration of the timer, as set by the timer dial 54, or at the time of day set by the timer dial 54.

A timer set button 56 may be coupled to the housing 12. For example, the timer set button 56 may be positioned on the peripheral wall 18 or on the front side 14. The timer set button 56 is electronically coupled to the central processing unit 36. The timer set button 56 is actuatable to adjust the timer. The central processing unit 36 is configured to actuate the motor 40 to retract the cord 26 upon expiration of the timer.

A retracting button 58 may be positioned on the front side 14. The retracting button 58 is electronically coupled to the central processing unit 36. Actuation of the retracting button 58 sends a signal to the central processing unit 36 to actuate the motor 40 to retract the cord 26.

In use, the shower curtain closure device 10 is installed on the wall 106, such that the shower rod recess 22 can receive one end of the shower curtain rod 100. The curtain clip 34 engages one shower curtain ring 102. The shower curtain is able to open and close manually as normal, by sliding along the shower curtain rod 100. Opening the shower curtain 104 pulls on the cord 26, which causes the cord 26 to unwrap from the spool 32 and extend outwardly from the housing 12, as shown in FIG. 8. When the shower curtain 104 is open, the shower curtain closure device 10 can pull the shower curtain 104 closed. In embodiments, the motor 40 spins the spool 32 to retract the cord 26 inwardly toward the housing 12. The cord 26 wraps around the spool 32 as the cord 26 retracts. The central processing unit 36 may automatically activate the motor 40. For example, the clock 38 may be set to automatically activate the motor at a specific time of the day, such as when the user typically starts or finishes a shower. The central processing unit 36 may also activate the motor 40 once the timer expires, for example 5.0 seconds after the user actuates the timer set button 56. The plurality of lights 48 can illuminate at least a portion of the bathroom space. For example, the plurality of lights 48 can be actuated to help find the shower curtain closure device 10 in the dark. The clock 38 may also be used to automatically activate the plurality of lights 48 at a specific time of day, for example when the user typically uses the shower. With the shower curtain closure device 10 installed, the user does not need to remember to close the shower curtain 104 manually when they are finished showering.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A curtain closure device comprising:

a housing having a front side, a back side, and a peripheral wall extending between the front side and the back side to define an interior space between the front side and the back side;

the front side having a rod recess therein, the rod recess being configured to receive a portion of a curtain rod;

a spool being positioned within the interior space, the spool being rotatably coupled to the housing;

a cord being extendable and retractable relative to the housing, the cord having a spool end and a clip end, the spool end being attached to the spool, the cord being wrapped around the spool, the clip end extending outwardly from the housing;

the spool rotating in a first direction to unwrap the cord for extension of the cord from the spool, the spool rotating in a second direction to wrap the cord around the spool for retraction of the cord to the spool;

a curtain clip being attached to the clip end, the curtain clip being configured to removably engage a curtain ring whereby the cord is configured to urge an end of a curtain being suspended from said curtain ring toward said housing when said cord is retracted into the housing;

a motor being positioned within the interior space, the motor being coupled to the spool such that the motor rotates the spool only in the second direction to retract the cord into the housing and onto the spool wherein the motor urges the curtain clip toward the housing and wherein the cord is configured for being extended from the housing only when a user manually pulls the curtain ring away from the housing;

a power source being positioned within the interior space, the power source being electronically coupled to the motor; and a retracting button being coupled to the housing, the retracting button being electronically coupled to the power source, the retracting button being operationally coupled to the motor wherein the motor is actuated by manipulation of the retracting button, thereby retracting the cord.

2. The curtain closure device of claim 1, further comprising an adhesive material being positioned on the back side.

3. The curtain closure device of claim 1, further comprising a padding material covering the housing within the rod recess.

4. The curtain closure device of claim 3, wherein the padding material is also positioned on the back side, the padding material providing an anti-slip grip to a wall surface, the padding material providing a protective barrier between the curtain closure device and the wall surface.

5. The curtain closure device of claim 1, wherein the rod recess extends partially across the front side.

6. The curtain closure device of claim 1, wherein the power source is a rechargeable battery.

7. The curtain closure device of claim 1, further comprising an access door being positioned on the back side, the access door permitting access to the power source within the interior space.

8. The curtain closure device of claim 1, further comprising a central processing unit being positioned within the interior space, the central processing unit being electronically coupled to the power source, the central processing unit being electronically coupled to the motor.

9. The curtain closure device of claim 8, wherein the central processing unit is electronically coupled to the retracting button, and wherein manipulation of the retracting button signals the central processing unit to actuate the motor, thereby retracting the cord.

10. The curtain closure device of claim 8, further comprising a plurality of lights being positioned on the peripheral wall, the plurality of lights being electrically coupled to the central processing unit, wherein the plurality of lights is controlled by the central processing unit.

11. The curtain closure device of claim 10, wherein each of the plurality of lights is a light emitting diode.

12. The curtain closure device of claim 10, further comprising a light control dial being rotatably coupled to the housing, the light control dial being electronically coupled to the central processing unit, wherein the central processing unit illuminates the plurality of lights when the light control dial is actuated.

13. The curtain closure device of claim 12, the light control dial being actuatable to adjust a light setting of the plurality of lights, the light setting including a brightness, a color, or an illumination pattern.

14. The curtain closure device of claim 10, further comprising a light control button being positioned on the front side, the light control button being in communication with the central processing unit, wherein the central processing unit turns the plurality of lights on or off when the light control button is manipulated.

15. The curtain closure device of claim 8, the central processing unit further comprising a clock, the clock having a timer.

16. The curtain closure device of claim 15, further comprising a timer dial being rotatably positioned on the peripheral wall, the timer dial being in communication with the clock, the timer dial being actuatable to adjust a clock setting, the clock setting including a time of day, the central processing unit actuating the motor at the time of day to retract the cord.

17. The curtain closure device of claim 15, further comprising a timer set button being coupled to the housing, the timer set button being in communication with the central processing unit, the timer set button being actuatable to adjust the timer, the timer lasting at least 1.0 second.

18. A curtain closure device comprising:

a housing having a front side, a back side, and a peripheral wall extending between the front side and the back side to define an interior space between the front side and the back side, wherein the housing is configured to inhibit penetration of water into the interior space;

the front side having a shower rod recess therein, the shower rod recess being configured to receive a portion of a shower curtain rod, the shower rod recess extending partially across the front side, the shower rod recess having a circular shape;

a padding material covering the housing within the shower rod recess;

a cord being coupled to the housing, the cord extending outwardly from the front side, the cord having a spool end and a clip end;

a spool being positioned within the interior space, the spool end being attached to the spool, the cord being coiled around the spool, the spool rotating in a first direction to uncoil the cord for extension of the cord from the spool, the spool rotating in a second direction to coil the cord around the spool for retraction of the cord onto the spool;

a curtain clip being attached to the clip end, the curtain clip being configured to removably engage a shower curtain ring;

a central processing unit being positioned within the interior space;

a clock being electronically coupled to the central processing unit, the clock measuring minutes and hours, the clock having a timer;

a motor being positioned within the interior space, the motor being electronically coupled to the central processing unit, the motor being coupled to the spool, the motor rotating the spool in the second direction such that the cord retracts into the housing and onto the spool;

a power source being positioned within the interior space, the power source being electronically coupled to the central processing unit, the power source being a rechargeable battery;

an access door being positioned on the back side, the access door permitting access to the power source within the interior space, the access door being positioned in a midsection of the back side;

the padding material being positioned on the back side, the padding material providing an anti-slip grip to a shower wall surface;

a plurality of lights being affixed to the peripheral wall, the plurality of lights being electronically coupled to the central processing unit, the central processing unit illuminating the plurality of lights, each of the plurality of lights being a light emitting diode;

a light control dial being rotatably positioned on the peripheral wall, the light control dial being electronically coupled to the central processing unit, wherein the central processing unit controls a light setting of at least one of the plurality of lights when the light control dial is actuated, the light control dial being actuatable to adjust the light setting of the plurality of lights, the light setting including a brightness, a color, or an illumination pattern;

a light control button being positioned on the front side, the light control button being electronically coupled to the central processing unit, the central processing unit illuminating or unilluminating the plurality of lights when the light control button is actuated, the light control button being actuatable to turn the plurality of lights on or off;

a timer dial being rotatably positioned on the peripheral wall, the timer dial being electronically coupled to the central processing unit, the timer dial being actuatable to adjust a clock setting of the clock, the clock setting including an hourly timer or a time of day, the hourly timer lasting at least 1.0 hour, the central processing unit actuating the motor to retract the cord upon expiration of the hourly timer, the central processing unit actuating the motor at the time of day to retract the cord;

a timer set button being positioned on the peripheral wall, the timer set button being electronically coupled to the central processing unit, the timer set button being actuatable to adjust the timer, the timer lasting at least 1.0 seconds, the central processing unit being configured to actuate the motor to retract the cord upon expiration of the timer; and a retracting button being positioned on the front side, the retracting button being electronically coupled to the central processing unit, the retracting button actuating the motor to retract the cord.

* * * * *